United States Patent [19]

Blum et al.

[11] 4,400,174

[45] Aug. 23, 1983

[54] PROCESS FOR PRINTING ON SYNTHETIC FIBERS: REDUCING AGENT AND ALKOXYLATED AMINE FOR DISCHARGE

[75] Inventors: Adolf Blum; Norbert Grund, both of Ludwigshafen, Fed. Rep. of Germany

[73] Assignee: BASF Aktiengesellschaft, Ludwigshafen, Fed. Rep. of Germany

[21] Appl. No.: 364,200

[22] Filed: Apr. 1, 1982

[30] Foreign Application Priority Data

Apr. 4, 1981 [DE] Fed. Rep. of Germany ..... 3113732

[51] Int. Cl.[3] ..... D06P 3/26

[52] U.S. Cl. ..... 8/456; 8/464; 8/592; 8/604; 8/921; 8/922; 8/924

[58] Field of Search ..... 8/464, 585, 590, 592, 8/604, 456

[56] References Cited

U.S. PATENT DOCUMENTS

| | | | |
|---|---|---|---|
| 2,874,022 | 2/1959 | Raff et al. | 8/461 |
| 4,265,629 | 5/1981 | Ribka et al. | 8/449 |
| 4,314,811 | 2/1982 | Feess et al. | 8/457 |
| 4,314,812 | 2/1982 | Feess | 8/457 |

FOREIGN PATENT DOCUMENTS 2753696 6/1979 Fed. Rep. of Germany .

*Primary Examiner*—A. Lionel Clingman

*Attorney, Agent, or Firm*—Bernhard R. Swick

[57] ABSTRACT

Process for printing on synthetic fibers of polyester, triacetate, acetate and polyamide as well as mixtures of these substances with disperse dyes according to the discharge or reserve discharge process, wherein a mixture of (a) 5 to 75 parts by weight of at least one reducing agent and (b) 5 to 90 parts by weight of a specified alkoxylated amine is used as the discharging agent.

9 Claims, No Drawings

PROCESS FOR PRINTING ON SYNTHETIC FIBERS: REDUCING AGENT AND ALKOXYLATED AMINE FOR DISCHARGE

BACKGROUND OF THE INVENTION

1. Field of the Invention

The invention relates to printing on synthetic fibers of polyester, triacetate, acetate and polyamide as well as mixtures thereof with disperse dyes.

2. Description of the Prior Art

German Pat. No. 1,086,209 describes printing pastes for the direct or discharge printing process on textile goods on native or regenerated cellulose, natural silk or linear polyamides. The dyestuffs used are vat and/or sulfur dyes. In addition to this, reserve discharging processes are known wherein either tin-(II)-chloride or oxymethane sulfinic zinc are used as discharging agents. German Pat. No. 2,753,696 describes a process for imprinting synthetic fibers of polyester, triacetate, acetate and polyamide, with disperse dyestuffs, according to the reserve discharging process where the discharge agent is a mixture of 5 to 50 parts by weight of an ammonium derivative containing at least one radical alkali metal or ammonium salt of methane sulfinic acid, 5 to 50 parts by weight of glucose and 0 to 10 parts by weight of anthraquinone.

A problem incurred with the familiar discharge and reserve discharge processes is presented by the decomposition products of the dischargeable dyestuffs impairing the whiteness of the background. In the case of multicolored illumination of the goods, clear colorations are not obtained.

Therefore, the purpose of this invention is to provide a process for imprinting synthetic fibers of polyester, triacetate, acetate, and polyamide, as well as mixtures of such fibers, with disperse dyes according to the discharge or reserve discharge process wherein the decomposition products of the dischargeable disperse dye do not cause any disturbing effects.

SUMMARY OF THE INVENTION

In accordance with this invention, this requirement is met by using as discharging agent a mixture of (a) 5 to 75 parts by weight of at least one reducing agent containing methane or ethane sulfinate groups, a monosaccharide, a disaccharide and/or thiourea dioxide having a reducing effect and (b) 5 to 90 parts by weight of an alkoxylated amine having the formulas

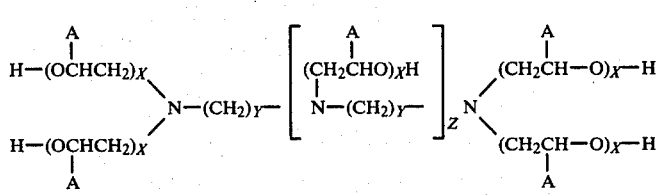

(I)

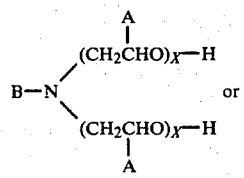

(II)

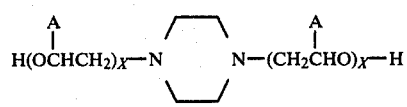

(III)

in which A represents hydrogen or methyl, B stands for $C_1$ to $C_4$ alkyl or a radical having the formula

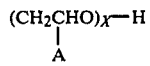

X=1, 2, 3 or 4, Y=2, 3, 4, 5 or 6 and Z=0, 1, 2 or 3.

DETAILED DESCRIPTION OF THE INVENTION AND THE PREFERRED EMBODIMENTS

Textile goods, for instance, fabrics or knitted goods of polyester, cellulose triacetate, cellulose acetate and polyamide or mixtures of the fibers are imprinted in accordance with the process of this invention. Textiles of the above-referenced materials are commercially available. The reserve discharge process may, for instance, be carried out in such a manner that the textile goods are initially padded with a liquor containing dischargeable disperse dye. Instead of padding, the textile material can also be imprinted with a printing paste containing a dischargeable disperse dye and a synthetic or natural thickener. The textile material is then dried under such conditions that the dyes are not yet set. Following this the material is imprinted with a mixture of a discharge resistant disperse dye and the discharging mixture and the material is dried. Subsequently the dyes are set, for instance, by the Thermosol process or by heating the textile goods in a hot steam atmosphere. Under these conditions the dischargeable dye is destroyed in those areas where the mixture of the discharge resistant dye and the discharging agent was imprinted. This process is referred to as reserve discharge since the background of the goods are dyed but the dye is not yet set.

A variation of the reserve discharging process consists of a mixture of the discharge resistant dye and the reducing agent being printed onto the textile material. This process is directly followed by the dischargeable dye being printed all over the textile goods, the material then being dried, and the dyes being set. When employing the discharge process, on the other hand, a dischargeable dye already set on the fabric is discharged according to the patterns by way of the mixture of discharging agents. All process variations also facilitate white discharging, that is in this case, a printing paste is used which contains the mixture of discharging agents but no dyestuff.

In the case of polyester, the dyeing process may be carried out by using carriers as well as under high temperature conditions, for instance, dyeing under pressure in aqueous liquor at 100° C. The reductive post cleaning required for polyester takes place after printing and setting, that is, the background and the areas printed for illumination, are reductively cleaned in one operation. The advantage of this type of dyeing lies in a better uniformity of the background which is particularly important when only individual, small areas are to be discharged in accordance with a pattern. Particularly with respect to knitted goods and very light fabrics, preliminary dyeing results in qualitative advantages. Synthetic fibers of acetate or polyamide and/or mixtures of these fibers are dyed at a temperature of 85° C. Disperse dyes are applicable for the process according to this invention on an almost exclusive basis. Suitable dyes of this type may be taken from the color index. Dischargeable disperse dyes are those which are decomposed by the discharging agent into products which generally should not influence the white background or the multi-colored illumination of the goods. Dischargeable disperse dyes are part of the group of the azo dyes. Suitable dischargeable dyes may be taken from the color index. Yellow disperse dye CI 11855 and the red disperse dyes CI 11150 and CI 11115 are mentioned only by way of example. The discharge resistant dyes are primarily disperse dyes based on anthraquinone derivatives. These are resistant to the discharging agents. Suitable discharge resistant disperse dyes are listed in the color index. Some of these are listed below by way of example:

yellow disperse dye CI 58900 and CI 47023
orange disperse dye CI 60700
red disperse dyes CI 607556, CI 62015 and CI 60756
violet disperse dye CI 61105
blue disperse dyes CI 61500, CI 62500 and CI 63285.

As Component (a) the mixture of discharge agents contains a reducing agent with methane or ethane sulfinate groups. Such compounds may be characterized for instance with the aid of Formula I

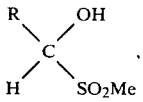

(IV)

in which R=H or $CH_3$ and Me=alkali metal, magnesium, calcium, zinc or ammonium groups. Suitable reducing agents also include ammonium derivatives which contain at least one radical of an alkali metal or ammonium salt of methane or ethane sulfonic acid. Compounds of this type are obtained by replacing one or more of the hydrogen atoms of ammonia or derivatives of ammonia, for instance of primary or secondary amines, such as mono- or diamines, such as methyl amine, dimethyl amine, isopropyl amine, n-butyl amine or ethylene diamine, of hydrazine or of urea, by the radical having the general formula $$-CH_2-SO_2Me \quad (V),$$

in which Me=alkali metal or an ammonia grouping. These ammonium derivatives are produced according to familiar processes by reacting ammonia or its derivatives containing at least one hydrogen atom bonded to nitrogen with alkali metal or ammonium salts of hydroxy methane sulfonic acid and/or hydroxy ethane sulfonic acid (compounds having Formula IV). During this reaction water is separated out. Preferably used are the sodium and potassium salts of ammonium derivatives of methane sulfonic acid. The ammonium groupings in Formula V may also be derived from amines. Preferably used are nitrilomethane sulfonic sodium having the formula $$N(CH_2SO_2Na)_3$$

and which is obtained by reacting ammonia with hydroxymethane sulfonic acid sodium in a mole ratio of 1:3 and the compound having the formula $$H_2N-CH_2SO_2Na,$$

which is produced by reacting ammonia with the sodium salt of hydroxy methane sulfonic acid in a mole ratio of 1:1.

Monosaccharides such as allose, altrose, mannose, gulose, idose, galactose, talose, arabinose, xylose, ribose, sorbose, fructose and glucose are also suitable substances for component (a) of the mixture of discharge agents. Preferably used among the monosaccharides are fructose, sorbose and glucose. Disaccharides with a reducing action include maltose, cellobiose or lactose.

Further suited as component (a) of the mixture of discharging agents are thioureadioxide. Of course it is also possible to use mixtures of two or more reducing agents. The mixture of discharging agents contains 5 to 75 parts by weight of the compounds of component (a).

For discharging dyed textiles which are dyed with a dischargeable disbursing dye, mixtures of discharging agents are preferably used which contain 0 to 50, preferably 5 to 40 parts by weight, of hexamethylene tetramine and 0 to 20 parts by weight of antharaquinone in addition to component A.

The mixtures of discharging agents containing hexamethylene tetramine and anthraquinone can also be used for the reserve discharge process. Hexamethylene tetramine brings about particularly clear shades of the illumination dyestuff when a reducting agent is used which contains methane or ethane sulfonate groups.

The amount of the reducing agents of component (a) used in every case for the discharging process depends upon the type of the background to be treated.

The alkoxylated compounds having formulas I, II and III are suitable as component (b) of the mixture of discharging agents. These compounds are obtained by reacting the basic amines with ethylene oxide and propylene oxide. A mixed gas of ethylene oxide and propylene oxide can be reacted with the amines for the alkoxylation or one can proceed in such a manner that ethylene oxide is introduced first, followed by propylene oxide or vice versa. The amines upon which formula I is based can be characterized, for instance, with the aid of the following formula $$H_2N-(CH_2)_Y-[NH-(CH_2)_Y]-NH_2 \quad (VI)$$

in this formula Y and Z have the meaning listed for formula I. Examples for these amines are ethylene diamine, propylene diamine, butylene diamine, pentamethylene diamine, hexamethylene diamine, diethylene diamine, diethylene triamine, triethylene tetramine and tetraethylene pentamine.

Examples for amines upon which the compounds in formula II are based include methyl amine, ethyl amine, propyl amine or butyl amine. The compounds of formula III are derived from piperazine.

Preferably used are alkoxylated amines which can be characterized with the aid of the following formulas:

(VII)

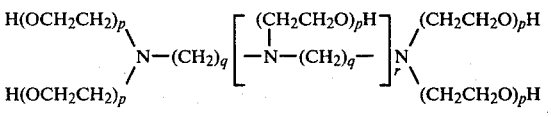

(VIII)

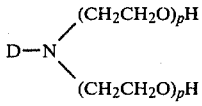

in these formulas p=1 or 2 q=2 or 3 and

D=$C_1$-$C_4$-Alkyl or $(CH_2CH_2O)_p$—H

Of specific technical importance for the process according to this invention are the ethoxylated amines having the formula (IX)

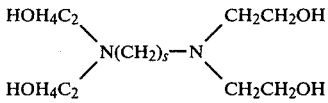

in which s stands for 2 or 3.

The mixture of discharging agents contains 5 to 95 parts by weight of an alkoxylated amine or a mixture of alkoxylated amines.

The printing paste with which the mixture of discharging agents is imprinted on the textile material generally contains thickeners in order to adjust the viscosity. Preferably used are natural thickeners such as modified starch ether, starch-tragacanth thickeners and alginates. 1000 parts by weight of the finished printing paste contain 20 to 100 parts by weight of the natural thickener. However it is also possible to use synthetic thickeners which are sensitive to electrolyte. Because of the electrolyte content in the discharge printing paste, however, greater quantities than normal are usually required. Suitable synthetic thickeners include high molecular polycarboxylic acids such as polyacrylic acid, polyacrylic acid crosslinked with crosslinking agents, as well as copolymerizates of ethylene and acrylic acid, or copolymerizates of styrene or ethylene and maleic anhydride. The synthetic thickeners develop their effectiveness in the pH range above 6. Mixtures of natural and synthetic thickeners may also be used. 1000 parts by weight of the printing paste contain 0.5 to 50 parts by weight of a disperse dye or a mixture of disperse dyes.

The printing pastes containing the discharging agent may also contain commonly used additives such as urea, setting agents, foam inhibitors, polyglycol, glycerine and alkali donors, that is, agents which liberate alkali during the setting process such as sodium or potassium bicarbonate or the sodium salt of trichloroacetic acid. The pH value of the printing paste containing the discharging agents normally lies between 7 and 12, preferably between 8 and 11.

The process of this invention excels in that clear shades of the illumination dye are achieved even when printing a small quantity of a discharge resistant dye onto a deep colored background. With the previously known discharge and reserve discharge processes, this characteristic does not exist to nearly as high a degree as with the process according to this invention. In the case of the previously known processes, and as a result of insufficient discharge effect, the basic color of the decomposition products of the background dye is superposed with those of the illumination dyes, or if too strong a reduction agent is used, not only the background dyes are destroyed, but also the illumination dyes are at least partially destroyed.

1000 parts by weight of the printing paste containing the discharge agent contain 10 to 450 parts by weight of the mixture of discharge agents.

The parts listed in the examples are parts by weight. The data in percent are relative to the weight of the substances unless otherwise noted.

EXAMPLE 1

A fabric of polyester is dyed in accordance with the exhaust process for 30 minutes at a temperature of 120° C. and a pH value in the range of 4.5 to 5 in an aqueous liquor containing 1.2 percent of the red disperse dye having the formula

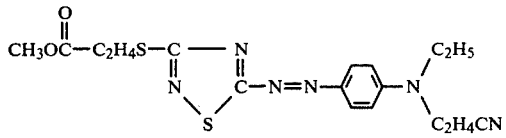

1.5 percent of the blue disperse dye having the formula

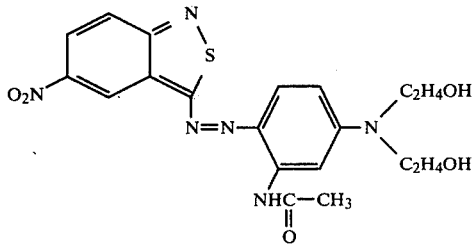

2.4 percent of the blue disperse dye having the formula:

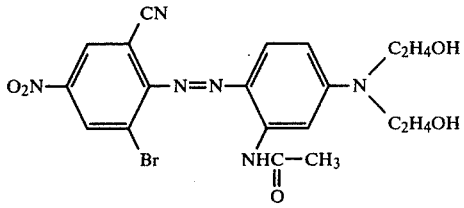

and 1.0 percent of the orange color disperse dye having the formula

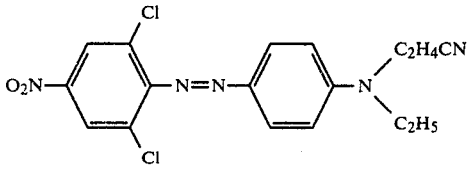

The goods dyed in the above referenced fashion are subsequently printed with a printing paste having the following composition:

| | |
|---|---|
| 500 | grams of modified starch ether thickener pH 7 (produced by dissolving 80 grams of modified starch ether in 1000 grams of water) |
| 40 | grams of nitrilomethane sulfonic sodium |
| 20 | grams of hexamethylene tetramine |
| 10 | grams of anthraquinone |
| 70 | grams of N,N,N',N'—[tetra-(2-hydroxyethyl)]-ethylene diamine |
| 20 | grams of the sodium salt of trichloroacetic acid |
| 50 | grams red disperse dye CI 62015 |
| 290 | grams of water |
| 1000 | grams |

The printed material is then dried and is subsequently treated with super heated steam under normal pressure at a temperature of 175° C. for a period of 8 minutes. Following this process the material is rinsed as usual and is cleaned reductively. A pink print on a black background is obtained.

EXAMPLE 2

A polyester fiber is padded with a liquor containing the following components:

60 grams per liter of a dischargeable dyestuff having the formula

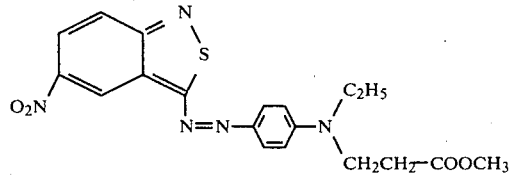

2 grams per liter of a copolymerizate consisting of 75 percent acrylic acid and 25 percent acrylamide which is partially neutralized with sodium hydroxide solution.

3 grams per liter of algenate, and 10 grams per liter of the sodium salt of nitrobenzene sulfonic acid.

The pH value of the padding liquor is adjusted to 5.5 by way of tartaric acid. Liquor absorption amounts to 70 percent. After padding the fabric is dried at a temperature between 90° and 100° C. and is subsequently imprinted with a printing paste having the following composition:

| | |
|---|---|
| 400 | grams modified starch ether thickener, 8 percent |
| 100 | grams starch ether thickener, 10 percent |
| 40 | grams sodium formaldehyde sulfoxylate |
| 20 | grams hexamethylene tetramine |
| 10 | grams maleic acid diethanol amide |
| 20 | grams polyethylene glycol (mol weight approximately 300) |
| 40 | grams urea |
| 60 | grams N,N,N',N'—tetra-(2-hydroxyethyl)-ethylene diamine |

-continued

| | |
|---|---|
| 10 | grams sodium bicarbonate |
| 40 | grams of the dyestuff having the formula |

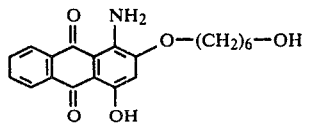

| | |
|---|---|
| 260 | grams water |
| 1000 | grams |

The imprinted material is dried and is subsequently treated with super heated steam under normal pressure at a temperature of 175° C. for a period of 8 minutes. Following this process the material is rinsed as usual and is cleaned reductively. A pink print on blue background is obtained. When printing onto a fabric dyed with the referenced dischargeable dyestuff, 10 to 20 grams per kilogram of anthraquinone are advantageously added to the printing dye.

EXAMPLE 3

As described in Example 2, a polyester fabric is padded with a liquor containing 60 grams per liter of the dischargeable dye having the formula

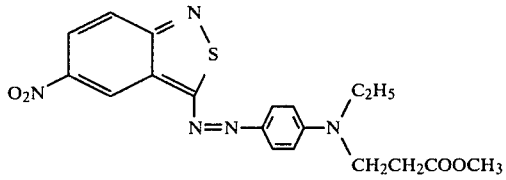

After drying at 90° to 100° C., the material is printed with a printing paste having the following composition:

| | |
|---|---|
| 500 | grams modified starch ether thickener (80 grams modified starch ether in 1000 grams of water) |
| 30 | grams nitrilomethane sulfinic sodium |
| 30 | grams glucose |
| 100 | grams N,N,N',N'—[tetra-(2-hydroxyethyl)]-ethylene diamine |
| 20 | grams sodium-m-nitrobenzene sulfonate |
| 8 | grams soda or sodium bicarbonate |
| 40 | grams of the dyestuff having the formula |

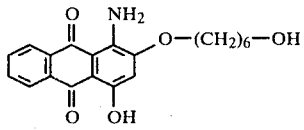

| | |
|---|---|
| 272 | grams water |
| 1000 | grams |

The printed material is dried and is subsequently treated with super heated steam under normal pressure at a temperature of 175° C. for a period of 6 minutes. Following this process this material is rinsed as usual and is cleaned reductively. A pink print on a blue background is obtained.

EXAMPLE 4

A polyester fabric is padded with a liquor having the following components:

60 grams per liter of a dischargeable dyestuff having the formula

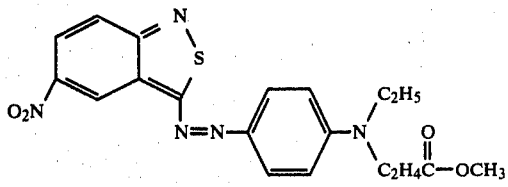

50 grams per liter of the dischargeable dyestuff having the formula

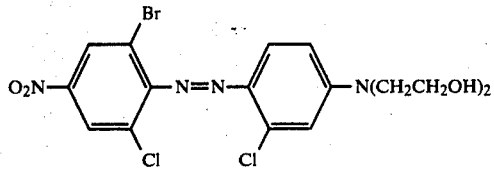

5 grams per liter of a dischargeable dyestuff having the formula

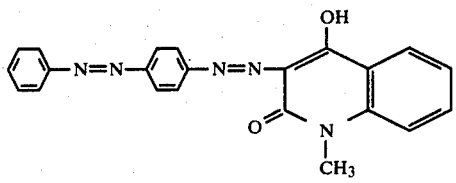

2 grams per liter of a copolymerizate consisting of 75 percent acrylic acid and 25 percent acrylamide which is partially neutralized with sodium hydroxide solution 3 grams per liter of alginate.

The pH value of the padding liquor is adjusted to 5.5 by means of tartaric acid. Liquor absorption amounts to 70 percent. After padding the material is dried at a temperature between 90° and 100° C. and is subsequently imprinted with a printing paste having the following composition:

| | |
|---|---|
| 400 | grams modified starch ether thickener, 8 percent |
| 100 | grams starch ether thickener, 10 percent |
| 100 | grams glucose |
| 150 | grams N,N,N',N'—[tetra-(2-hydroxyethyl)]-ethylene diamine |
| 50 | grams sodium acetate |
| 10 | grams urea |
| 5 | grams of a dye having the formula |

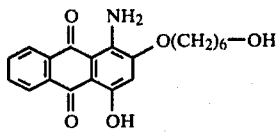

| | |
|---|---|
| 185 | grams water |
| 1000 | grams |

The imprinted material is dried and is subsequently treated with super heated steam under normal pressure at a temperature of 175° C. for a period of 6 minutes. Following this process the material is rinsed as usual and cleaned reductively. A pink print on black background is obtained.

The embodiments of the invention in which an exclusive privilege or property is claimed are defined as follows:

1. In the process for printing on synthetic fibers of polyester, triacetate, acetate and polyamide as well as mixtures thereof with disperse dyes according to the discharging or reserve discharging process the improvement wherein the discharging agent comprises a mixture of (a) 5 to 75 parts by weight of at least one reducing agent selected from the group consisting of methane or ethane sulfinate group containing reducing agents, monosaccharides, reducing disaccharides, thiourea dioxide and mixtures thereof.

(b) 5 to 90 parts by weight of an alkoxylated amine selected from the group consisting of alkoxylated amines having the formulas

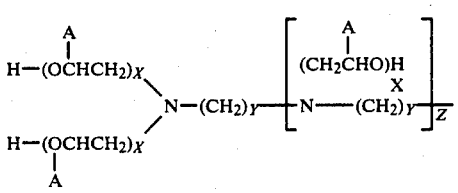

(I)

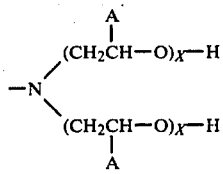

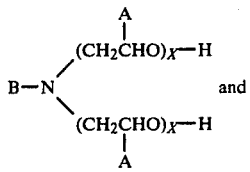

and (II)

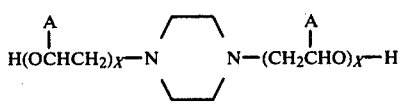

(III)

in which A represents hydrogen or methyl, B stands for $C_1$ to $C_4$ alkyl or a radical having the formula

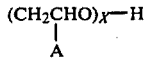

wherein

X=1, 2, 3 or 4, Y=2, 3, 4, 5 or 6 and Z=0, 1, 2 or 3.

2. The process according to claim 1 wherein component (a) of the discharging mixture also contains up to about 50 parts by weight of hexamethylene tetramine.

3. The process according to claims 1 or 2 wherein component (a) of the discharging mixture also contains up to to 20 parts by weight of anthraquinone.

4. The process according to any one of claims 1 through 3 wherein component (b) is N,N,N',N'-[tetra-(2-hydroxyethyl)]-ethylenediamine.

5. The process according to any one of claims 1 through 3 wherein component (b) is triethanolamine.

6. The process according to any one of claims 1 through 3 wherein component (b) is N,N'-[di-(2-hydroxyethyl)]piperazine.

7. The process according to any one of claims 1 through 6 wherein 1000 parts by weight of the printing paste containing the discharging agents contain 10 to 450 parts by weight of the discharge mixture.

8. The process according to any one of claims 1 through 6 wherein component (a) is a methane or ethane sulfinate group containing reducing agent.

9. The process according to any one of claims 1 through 6 wherein component (a) is a monosaccharide.

* * * * *